US010661951B1

(12) United States Patent
Montes

(10) Patent No.: US 10,661,951 B1
(45) Date of Patent: May 26, 2020

(54) PAINT CAN POURING ASSEMBLY

(71) Applicant: Carlos Montes, Oxnard, CA (US)

(72) Inventor: Carlos Montes, Oxnard, CA (US)

( * ) Notice: Subject to any disclaimer, the term of this patent is extended or adjusted under 35 U.S.C. 154(b) by 0 days.

(21) Appl. No.: 16/274,618

(22) Filed: Feb. 13, 2019

(51) Int. Cl.

| | |
|---|---|
| ***B65D 47/24*** | (2006.01) |
| ***B65D 55/00*** | (2006.01) |
| ***B44D 3/12*** | (2006.01) |
| *B44D 3/08* | (2006.01) |

(52) U.S. Cl.
CPC ..... *B65D 47/249* (2013.01); *B44D 3/127* (2013.01); *B65D 55/00* (2013.01); *B44D 3/08* (2013.01)

(58) Field of Classification Search
CPC ..... B65D 47/249; B65D 55/00; B44D 3/08; B44D 3/127
See application file for complete search history.

(56) References Cited

U.S. PATENT DOCUMENTS 2,177,178 A * 10/1939 Hays ..... B65D 47/286 222/545
2,585,334 A * 2/1952 McCauley ..... B01F 7/1695 220/326
3,507,309 A * 4/1970 Johnson ..... B05B 9/0805 141/18
3,672,547 A * 6/1972 Kozlowski ..... B44D 3/127 222/567
4,034,901 A * 7/1977 Kirk ..... B44D 3/127 222/481.5
4,240,568 A 12/1980 Pool
4,893,723 A * 1/1990 Seabolt ..... B44D 3/12 220/570
4,926,390 A * 5/1990 Murzsa ..... B01F 7/1695 220/298
5,054,687 A * 10/1991 Burns ..... B05B 7/24 220/751
5,137,188 A 8/1992 Thompson
5,199,788 A * 4/1993 Stallings ..... B01F 7/1695 366/247
5,533,802 A * 7/1996 Garganese ..... B01F 11/0082 366/256
5,720,408 A 2/1998 Schmid
5,855,304 A * 1/1999 Dean ..... B44D 3/12 220/570
5,893,489 A * 4/1999 Giarrante ..... B44D 3/127 220/254.8
5,941,427 A 8/1999 Speer
5,947,319 A * 9/1999 Sinski ..... B44D 3/127 220/254.3
6,126,048 A 10/2000 Bublitz
(Continued)

FOREIGN PATENT DOCUMENTS

WO WO1995011835 3/1995

*Primary Examiner* — Frederick C Nicolas

(57) ABSTRACT

A paint can pouring assembly for reducing spillage from a paint can includes a paint can that contains a fluid paint. The paint can has an opening therein and a disk is removably coupled to the paint can for closing the opening. The disk has a vent aperture extending therethrough to ventilate air from the paint can when the disk is positioned on the paint can. A spout is removably coupled to the disk for dispensing a selected amount of the fluid paint from the paint can when the disk is positioned on the paint can. Moreover, the spout inhibits the fluid paint from spilling out of the paint can to protect the environment from spilled fluid paint.

7 Claims, 5 Drawing Sheets

(56) References Cited

U.S. PATENT DOCUMENTS

| | | | | |
|---|---|---|---|---|
| 6,419,385 | B1 * | 7/2002 | Walls | B01F 7/1695 366/247 |
| 6,701,975 | B1 * | 3/2004 | Neal | B05B 9/03 141/18 |
| 8,414,180 | B1 * | 4/2013 | Mattingly | B01F 7/00283 366/247 |
| D793,530 | S | 8/2017 | Hegdahl | |
| 2001/0027985 | A1 * | 10/2001 | Arabnia | B44D 3/127 222/473 |
| 2005/0247744 | A1 * | 11/2005 | Nottingham | B44D 3/12 222/568 |
| 2017/0203887 | A1 | 7/2017 | Hegdahl | |

* cited by examiner

PAINT CAN POURING ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to paint pouring devices and more particularly pertains to a new paint pouring device for reducing spillage from a paint can.

BRIEF SUMMARY OF THE INVENTION

An embodiment of the disclosure meets the needs presented above by generally comprising a paint can that contains a fluid paint. The paint can has an opening therein and a disk is removably coupled to the paint can for closing the opening. The disk has a vent aperture extending therethrough to ventilate air from the paint can when the disk is positioned on the paint can. A spout is removably coupled to the disk for dispensing a selected amount of the fluid paint from the paint can when the disk is positioned on the paint can. Moreover, the spout inhibits the fluid paint from spilling out of the paint can to protect the environment from spilled fluid paint.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
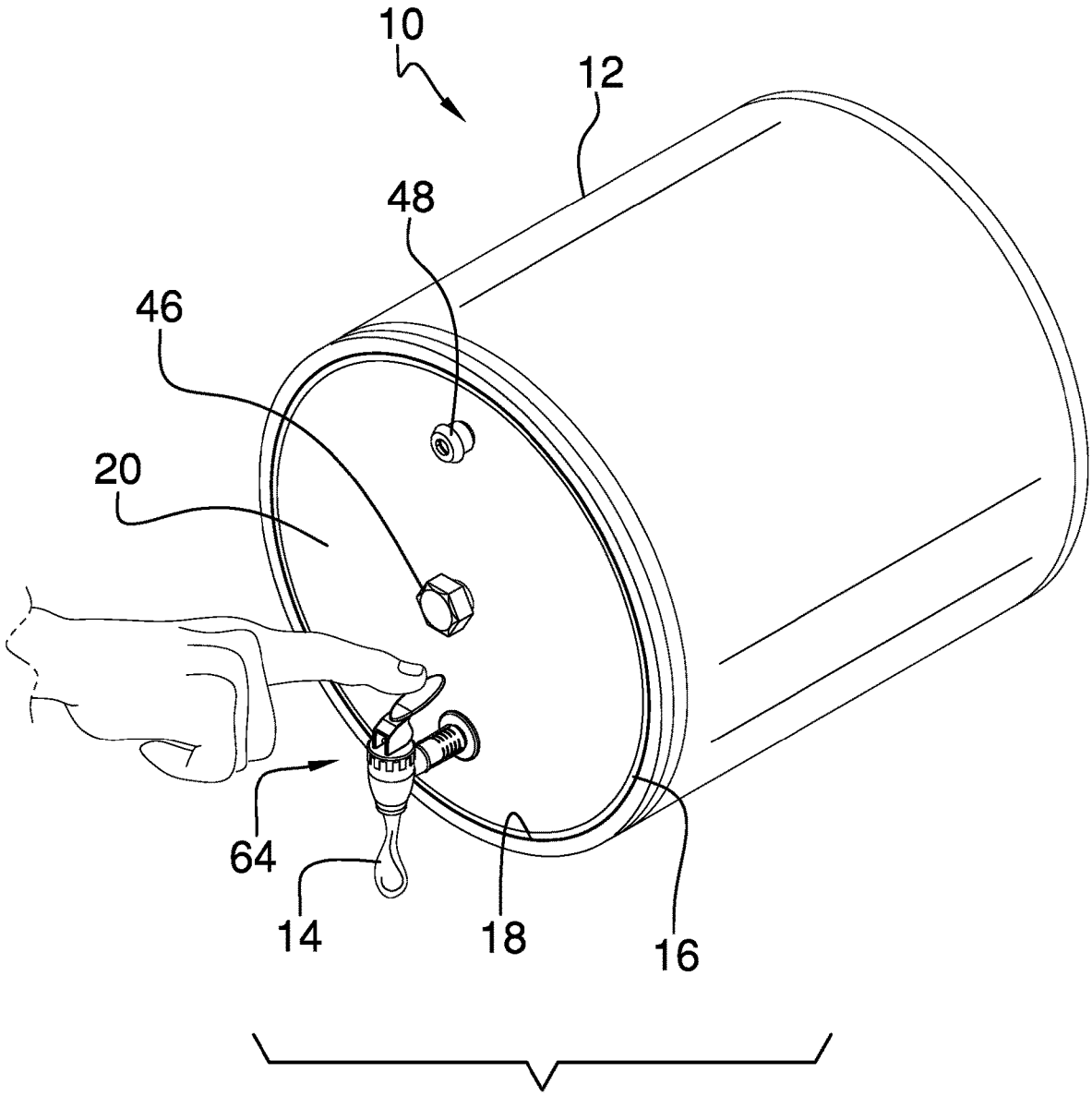
FIG. 1 is a perspective in-use view of a paint can pouring assembly according to an embodiment of the disclosure.
Figure 2:
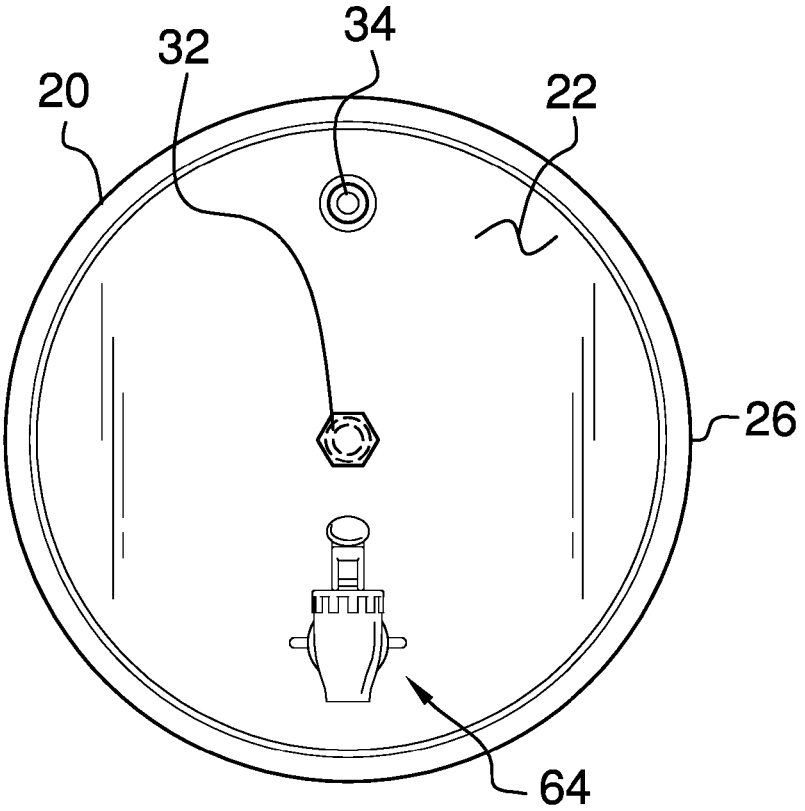
FIG. 2 is a front view of a disk of an embodiment of the disclosure.
Figure 3:
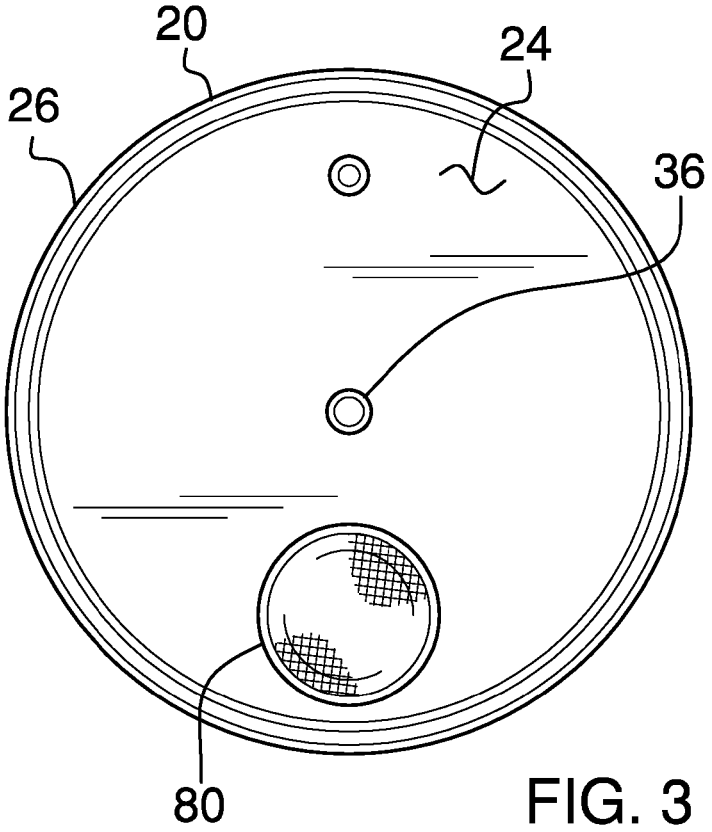
FIG. 3 is a back view of a disk of an embodiment of the disclosure.
Figure 4:
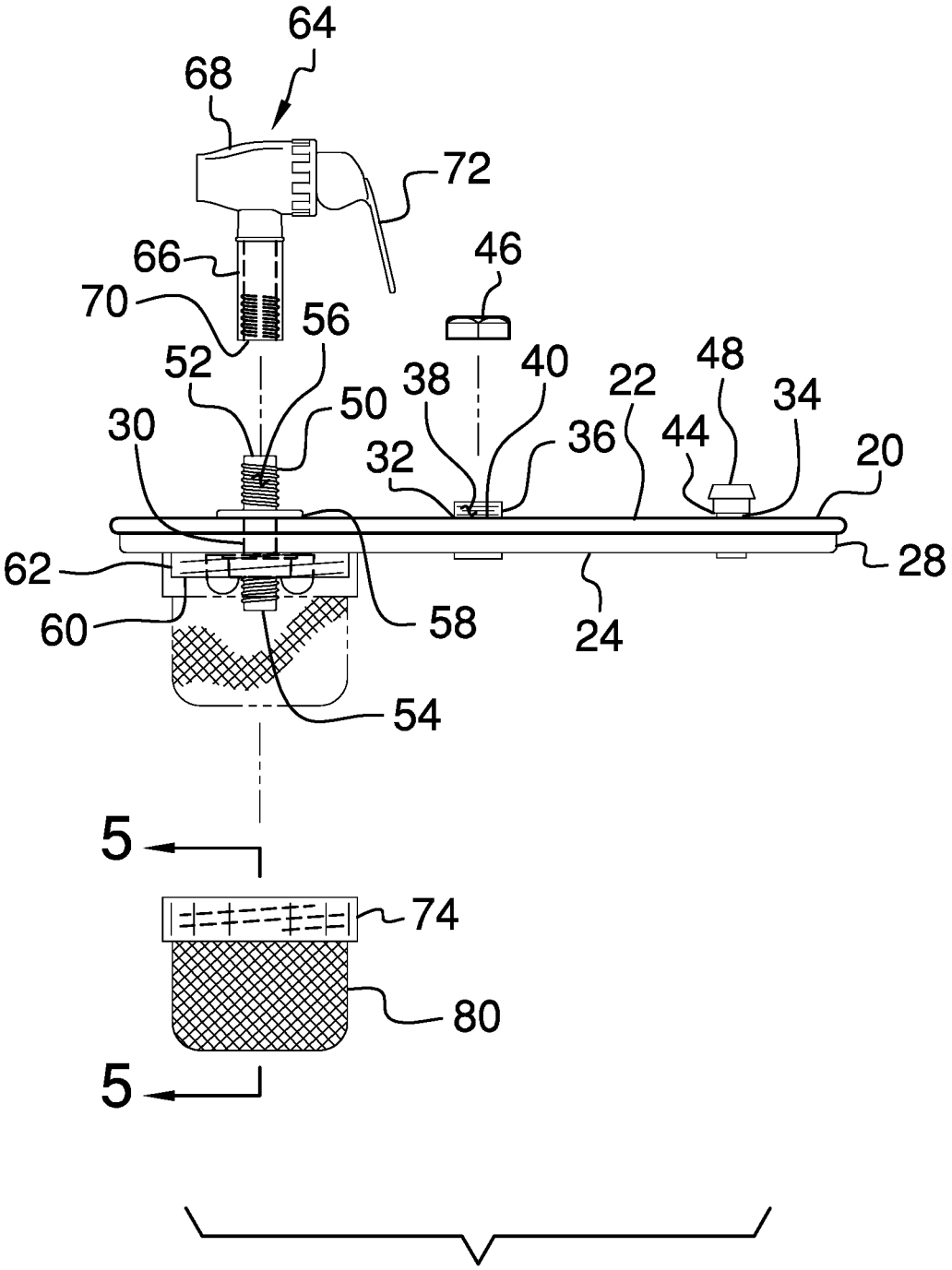
FIG. 4 is an exploded perspective view of an embodiment of the disclosure.
Figure 5:
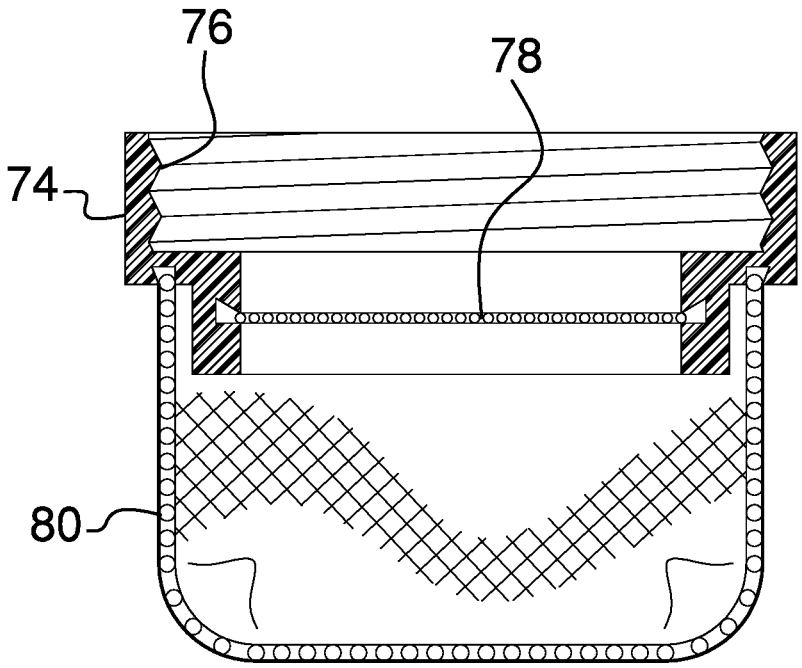
FIG. 5 is a cross sectional view taken along line 5-5 of FIG. 4 of an embodiment of the disclosure.
Figure 6:
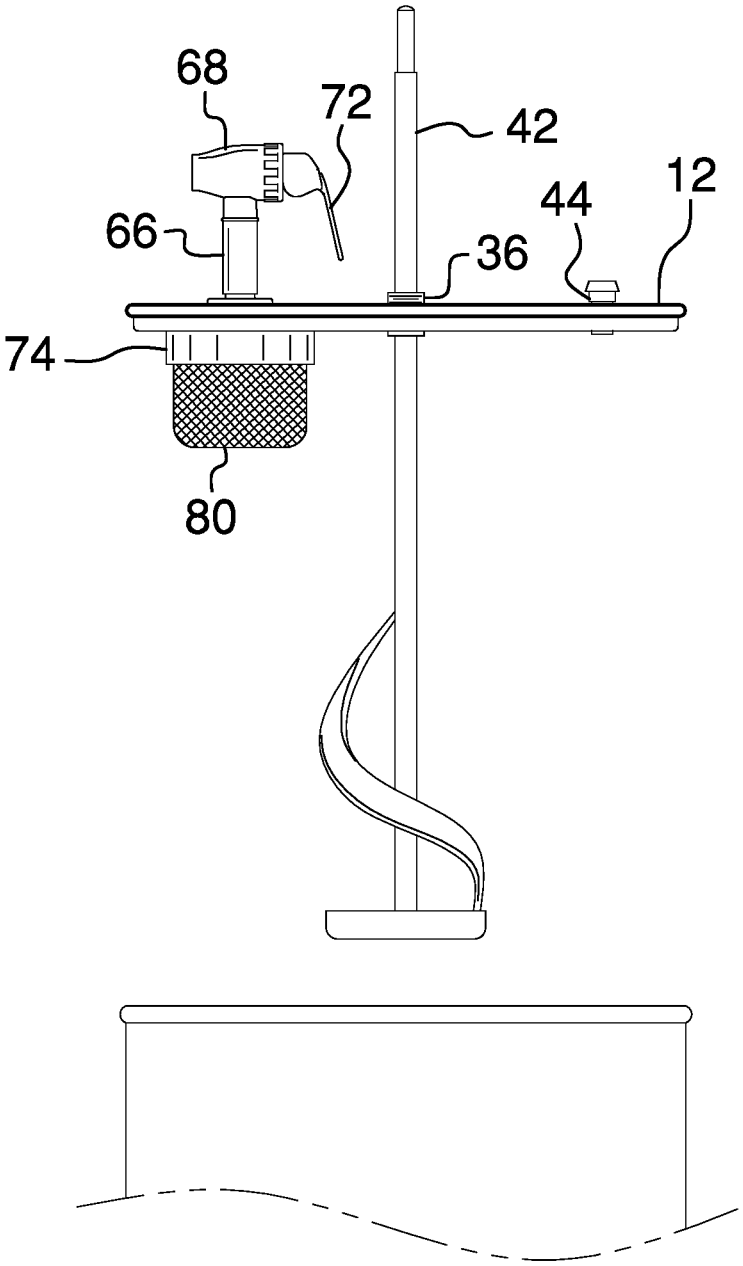
FIG. 6 is an exploded perspective view of an embodiment of the disclosure showing a stirring aperture being extended through a stir sleeve.

With reference now to the drawings, and in particular to FIGS. 1 through 6 thereof, a new paint pouring device embodying the principles and concepts of an embodiment of the disclosure and generally designated by the reference numeral 10 will be described.

As best illustrated in FIGS. 1 through 6, the paint can pouring assembly 10 generally comprises a paint can 12 containing a fluid paint 14. The paint can 12 has an opening 16 therein and a lip 18 extending around the opening 16. The paint can 12 may be a paint can of any conventional size and the fluid paint 14 may be oil based paint, water based paint or any other type of fluid paint. A disk 20 is removably coupled to the paint can 12 for closing the opening 16 when a lid of the paint can 12 has been removed.

The disk 20 has a first surface 22, a second surface 24 and a perimeter edge 26 extending therebetween, and second surface 24 has a vertical edge 28 that is inset from the perimeter edge 26. The vertical edge 28 engages the lip 18 when the disk 20 is positioned on the paint can 12. The disk 20 has a spout aperture 30 extending through the first 22 and second 24 surfaces, and the disk 20 has a stir aperture 32 extending through the first 22 and second 24 surfaces. The disk 20 has a vent aperture 34 extending through the first 22 and second 24 surfaces to ventilate air from the paint can 12 when the disk 20 is positioned on the paint can 12. The disk 20 may be manufactured in a variety of diameters thereby facilitating the disk 20 to fit every size of paint can 12.

A stir sleeve 36 is positioned in the stir aperture 32, the stir sleeve 36 has an outer surface 38, the outer surface 38 is threaded and the stir sleeve 36 has a distal end 40 with respect to the first surface 22 of the disk 20. A stirring apparatus 42 is extendable through the stir sleeve 36 for stirring the fluid paint 14 in the paint can 12 when the disk 20 is positioned on the paint can 12. A vent sleeve 44 is positioned in the vent aperture 34. A stir cap 46 threadably engages the outer surface 38 of the stir sleeve 36 for closing the distal end 40 of the stir sleeve 36 and a vent cap 48 is removably coupled to the vent sleeve 44 for closing the vent sleeve 44.

A spout sleeve 50 is positioned in the spout aperture 30. The spout sleeve 50 has a first end 52, a second end 54 and an outside surface 56 extending therebetween, and the outside surface 56 is threaded. The first end 52 is spaced from the first surface 22 of the disk 20 and the second end 54 is spaced from the second end 54 of the disk 20. A washer 58 is positioned around the outside surface 56 of the spout sleeve 50 and the washer 58 abuts the first surface 22 of the disk 20. A nut 60 is threadably positioned around the outside surface 56 of the spout sleeve 50. The nut 60 is tightened against the second surface 24 of the disk 20 thereby compressing the disk 20 between the washer 58 and the nut 60. Additionally, the nut 60 has an outwardly facing surface 62 and the outwardly facing surface 62 is threaded.

A spout 64 is provided and the spout 64 is removably coupled to the disk 20 for dispensing a selected amount of the fluid paint 14 from the paint can 12 when the disk 20 is positioned on the paint can 12. The spout 64 inhibits the fluid paint 14 from spilling out of the paint can 12 thereby protecting the environment from spilled fluid paint 14. The spout 64 has a stem 66 and a valve 68, and the stem 66 has a distal end 70 with respect to the valve 68. The distal end 70 of the stem 66 is open for insertably receiving the first end 52 of the spout sleeve 50 having the stem 66 threadably engaging the outside surface 56 of the spout sleeve 50. Moreover, the valve 68 is positionable in an open position for releasing the fluid paint 14 from the valve 68 and the valve 68 is biased into a closed position for inhibiting the fluid paint 14 from passing through the valve 68. The valve 68 may include a lever 72 that is depressible for urging the valve 68 into the open position.

A fitting 74 is included that has an interior surface 76 and the interior surface 76 threadably engages the outwardly facing surface 62 of the nut 60 thereby removably attaching the fitting 74 to the nut 60. A filter 78 is coupled to the interior surface 76 of the fitting 74 and the filter 78 is comprised of a fluid permeable material for filtering the fluid paint 14 when the fluid paint 14 passes through the filter 78. A basket 80 is coupled around the fitting 74 such that the basket 80 surrounds the filter 78. The basket 80 is comprised of a mesh material such that the fluid paint 14 passes through the basket 80 for filtering the fluid paint 14.

In use, the disk 20 is fitted onto the paint can 12 when the lid of the paint can 12 is removed. The spout 64 is manipulated to dispense a selected amount of the fluid paint 14 from the paint can 12 in a controlled pour. In this way the fluid paint 14 can be poured into a paint pan, a paint gun or other object while minimizing spilling of the fluid paint 14. Additionally, the disk 20 inhibits the lip 18 on the paint can 12 from filling with paint as would happen if the fluid paint 14 were poured directly out of the paint can 12. Thus, the spout 64 and the disk 20 minimize waste when the fluid paint 14 is poured from the paint can 12. Additionally, the stirring apparatus 42 can be extended through said stir sleeve 36 for stirring the fluid paint 14 in the paint can 12 while the disk 20 is positioned on the paint can 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint can pouring assembly being configured to dispense a selected amount of paint from a paint can without having to pour the paint directly from the paint can, said assembly comprising:

a paint can containing a fluid paint, said paint can having an opening therein and a lip extending around said opening;

a disk being removably coupled to said paint can for closing said opening, said disk having a vent aperture extending therethrough wherein said vent aperture is configured to ventilate air from said paint can when said disk is positioned on said paint can;

a spout being removably coupled to said disk for dispensing a selected amount of said fluid paint from said paint can when said disk is positioned on said paint can, said spout inhibiting said fluid paint from spilling out of said paint can wherein said spout is configured to protect the environment from spilled fluid paint; and wherein said disk has a first surface, a second surface and a perimeter edge extending therebetween, said second surface having a vertical edge being inset from said perimeter edge, said vertical edge engaging said lip when said disk is positioned on said paint can, said disk having a spout aperture extending through said first and second surfaces, said disk having a stir aperture extending through said first and second surfaces, said vent aperture extending through said first and second surfaces.

2. The assembly according to claim 1, further comprising:

a stir sleeve being positioned in said stir aperture, said stir sleeve having an outer surface, said outer surface being threaded, said stir sleeve having a distal end with respect to said first surface of said disk, said stir sleeve having a stirring apparatus being extendable therethrough for stirring said fluid paint in said paint can when said disk is positioned on said paint can; and a stir cap threadably engaging said outer surface of said stir sleeve for closing said distal end of said stir sleeve.

3. The assembly according to claim 1, further comprising:

a vent sleeve being positioned in said vent aperture; and a vent cap being removably coupled to said vent sleeve for closing said vent sleeve.

4. The assembly according to claim 1, further comprising:

a spout sleeve being positioned in said spout aperture, said spout sleeve having a first end, a second end and an outside surface extending therebetween, said outside surface being threaded, said first end being spaced from said first surface of said disk, said second end being spaced from said second end of said disk;

a washer being positioned around said outside surface of said spout sleeve, said washer abutting said first surface of said disk; and a nut being threadably positioned around said outside surface of said spout sleeve, said nut being tightened against said second surface of said disk thereby compressing said disk between said washer and said nut, said nut having an outwardly facing surface, said outwardly facing surface being threaded.

5. The assembly according to claim 4, wherein said spout has a stem and a valve, said stem having a distal end with respect to said valve, said distal end being open for insertably receiving said first end of said spout sleeve having said stem threadably engaging said outside surface of said spout sleeve, said valve being positionable in an open position for releasing said fluid paint from said valve, said valve being biased into a closed position for inhibiting said fluid paint from passing through said valve.

6. The assembly according to claim 5, further comprising:

a fitting having an interior surface, said interior surface threadably engaging said outwardly facing surface of said nut thereby removably attaching said fitting to said nut;

a filter being coupled to said interior surface of said fitting, said filter being comprised of a fluid permeable material such that said filter filters said fluid paint when said fluid paint passes through said filter; and a basket being coupled around said fitting such that said basket surrounds said filter, said basket being comprised of a mesh material such that said fluid paint passes through said basket for filtering said fluid paint.

7. A paint can pouring assembly being configured to dispense a selected amount of paint from a paint can without having to pour the paint directly from the paint can, said assembly comprising:

a paint can containing a fluid paint, said paint can having an opening therein and a lip extending around said opening;

a disk being removably coupled to said paint can for closing said opening, said disk having a first surface, a second surface and a perimeter edge extending therebetween, said second surface having a vertical edge being inset from said perimeter edge, said vertical edge engaging said lip when said disk is positioned on said paint can, said disk having a spout aperture extending through said first and second surfaces, said disk having a stir aperture extending through said first and second surfaces, said disk having a vent aperture extending through said first and second surfaces wherein said vent aperture is configured to ventilate air from said paint can when said disk is positioned on said paint can;

a stir sleeve being positioned in said stir aperture, said stir sleeve having an outer surface, said outer surface being threaded, said stir sleeve having a distal end with respect to said first surface of said disk, said stir sleeve having a stirring apparatus being extendable therethrough for stirring said fluid paint in said paint can when said disk is positioned on said paint can;

a vent sleeve being positioned in said vent aperture;

a stir cap threadably engaging said outer surface of said stir sleeve for closing said distal end of said stir sleeve;

a vent cap being removably coupled to said vent sleeve for closing said vent sleeve;

a spout sleeve being positioned in said spout aperture, said spout sleeve having a first end, a second end and an outside surface extending therebetween, said outside surface being threaded, said first end being spaced from said first surface of said disk, said second end being spaced from said second end of said disk;

a washer being positioned around said outside surface of said spout sleeve, said washer abutting said first surface of said disk;

a nut being threadably positioned around said outside surface of said spout sleeve, said nut being tightened against said second surface of said disk thereby compressing said disk between said washer and said nut, said nut having an outwardly facing surface, said outwardly facing surface being threaded;

a spout being removably coupled to said disk for dispensing a selected amount of said fluid paint from said paint can when said disk is positioned on said paint can, said spout inhibiting said fluid paint from spilling out of said paint can wherein said spout is configured to protect the environment from spilled fluid paint, said spout having a stem and a valve, said stem having a distal end with respect to said valve, said distal end being open for insertably receiving said first end of said spout sleeve having said stem threadably engaging said outside surface of said spout sleeve, said valve being positionable in an open position for releasing said fluid paint from said valve, said valve being biased into a closed position for inhibiting said fluid paint from passing through said valve;

a fitting having an interior surface, said interior surface threadably engaging said outwardly facing surface of said nut thereby removably attaching said fitting to said nut;

a filter being coupled to said interior surface of said fitting, said filter being comprised of a fluid permeable material such that said filter filters said fluid paint when said fluid paint passes through said filter; and a basket being coupled around said fitting such that said basket surrounds said filter, said basket being comprised of a mesh material such that said fluid paint passes through said basket for filtering said fluid paint.

* * * * *